US007380385B2

(12) United States Patent
Yoon

(10) Patent No.: US 7,380,385 B2
(45) Date of Patent: Jun. 3, 2008

(54) ADJUSTABLE LENGTH DECORATION PANEL

(76) Inventor: Byung Mo Yoon, C-508, Samyoung Apt., 140, Kajwa-dong, Seo-gu, Incheon (KR)

( * ) Notice: Subject to any disclaimer, the term of this patent is extended or adjusted under 35 U.S.C. 154(b) by 525 days.

(21) Appl. No.: 10/800,615

(22) Filed: Mar. 16, 2004

(65) Prior Publication Data

US 2005/0000180 A1 Jan. 6, 2005

(30) Foreign Application Priority Data

Jul. 3, 2003 (KR) ..... 10-2003-0044956

(51) Int. Cl.
*E04B 1/00* (2006.01)

(52) U.S. Cl. ..... 52/784.1; 52/100; 52/800.18

(58) Field of Classification Search ..... 52/202, 52/473, 782.1, 784.1, 100, 800.11, 800.12, 52/800.13; 49/403, 383, 74.1, 82.1, 298, 49/336, 362, 67, 90.1, 87.1
See application file for complete search history.

(56) References Cited

U.S. PATENT DOCUMENTS 4,251,966 A * 2/1981 Foltman ..... 52/309.1
4,765,110 A * 8/1988 MacLeod ..... 52/473
5,347,782 A * 9/1994 Vagedes ..... 52/473
5,430,986 A * 7/1995 Vagedes ..... 52/473
5,524,407 A * 6/1996 Ricard et al. ..... 52/473
5,617,688 A * 4/1997 Gandy et al. ..... 52/473
5,630,295 A * 5/1997 Neiman ..... 49/403
5,740,639 A * 4/1998 Covington ..... 52/202
5,787,642 A * 8/1998 Coyle et al. ..... 49/61
5,887,386 A * 3/1999 Alexanian et al. ..... 49/403
5,924,255 A * 7/1999 Vagedes ..... 52/473
6,122,875 A * 9/2000 Schiedegger et al. ..... 52/457
6,314,680 B1 * 11/2001 Buckwalter et al. ..... 49/82.1
6,314,690 B1 * 11/2001 Lilie et al. ..... 52/204.61
6,536,162 B2 * 3/2003 LaMay ..... 49/403
6,810,621 B1 * 11/2004 Ricci ..... 49/90.1
6,848,213 B1 * 2/2005 Swapp ..... 49/82.1
6,996,934 B2 * 2/2006 Briscoe et al. ..... 49/67

* cited by examiner

*Primary Examiner*—Richard Chilcot
*Assistant Examiner*—Gay Ann Spahn
(74) *Attorney, Agent, or Firm*—Bacon & Thomas, PLLC

(57) ABSTRACT

A decoration panel the length of which is adjustable so that it may be fitted to a various sizes of walls, windows, furniture and so on. The decoration panel includes a main panel having a plurality of holes aligned on the upper or lower part of it in the vertical direction. Sub panels having a front cover and a plurality of holes on the rear of the front cover corresponding in spacing to the holes are inserted on the upper or lower end of the main panel. A joiner is engaged through the holes of the sub panel into the holes of the main panel.

2 Claims, 4 Drawing Sheets

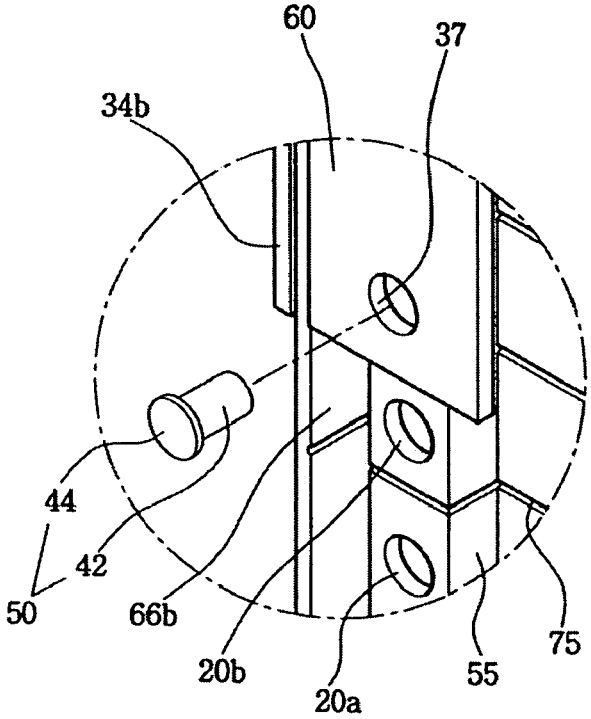
FIG. 3A
FIG. 3
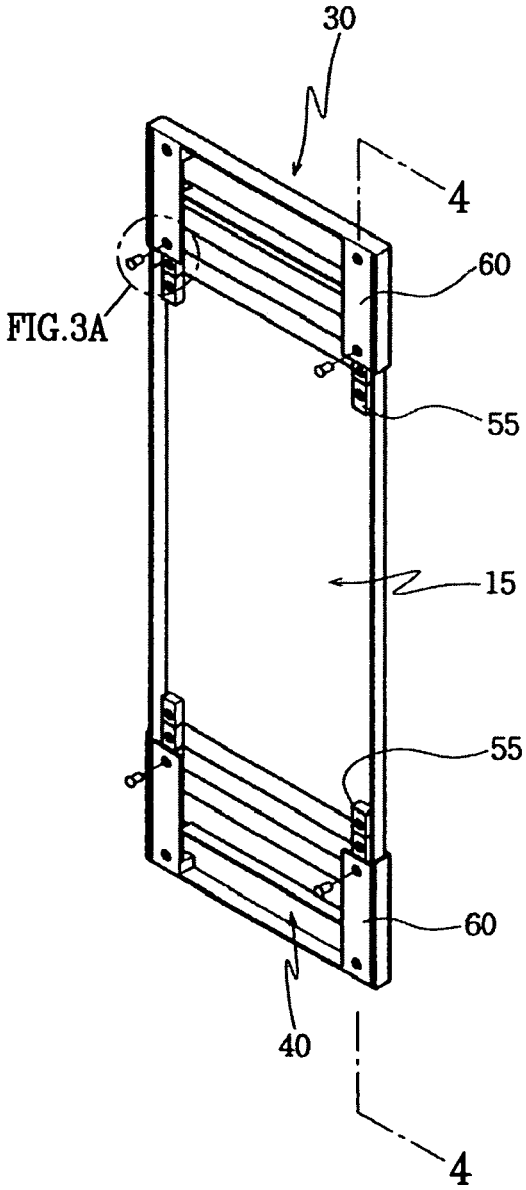

ADJUSTABLE LENGTH DECORATION PANEL

FIELD OF THE INVENTION

This invention relates to a decoration panel, and more particularly to a decoration panel wherein the length of the panel is adjustable to be fitted to a various sizes of walls, windows, furniture and so on, and wherein the cost of manufacturing for the various sizes is reduced.

BACKGROUND OF THE INVENTION

Decoration panels are widely used on both sides of windows, peripheries of room walls or furniture. Such decoration panels are fixed on the walls adjacent to the windows or the furniture by way of screws. But the windows or furniture are made in various sizes depending on their location, therefore the decoration panels must also be made in various sizes corresponding to the sizes of walls, windows or furniture. That is, a decoration panel of single size can not be used for all walls, windows or furniture. Therefore, the panel makers must prepare many apparatuses or moulds to meet the various sizes of decoration panels, which will result in high cost of manufacturing.

SUMMARY OF THE INVENTION

The invention is provided to solve the problems as described above and the object of the invention is to suggest a novel decoration panel wherein the length is adjustable to be fitted to a various sizes of windows or furniture and so on, and the cost of manufacturing apparatus for the various sizes can be reduced.

According to one aspect of the invention, there is provided a decoration panel to be installed on walls which comprises a main panel 15 having a plurality of first holes 20 aligned on the upper or lower part of it in the vertical direction, a sub panels 30, 40 having a front cover 31 and a plurality of second holes 37*a*, 37*b* on the rear of the front cover 31 corresponding in spacing to the holes 20 and being inserted on the upper or lower end of the main panel 15, and a joiner (fastener) 50 being engaged through the holes 37*a*, 37*b* of the sub panel 30, 40 into the holes 20 of the main panel 15 to join the sub panel 30, 40 to the upper or lower part of the main panel 15, wherein the length of the decoration panel is adjustable by selectively inserting the joiner 50 with the holes 37*a*, 37*b* of the sub panel 30 and the corresponding holes 20 of the main panel 15.

According to the other aspect of the invention, there is provided a decoration panel wherein the first holes 20 are formed on the first strips 55 disposed on the upper or lower part of rear of the main panel 15 in a longitudinal direction, and the second holes 37*a*, 37*b* are formed on the second strips 60 disposed on the rear of the front cover 31 of the sub panels 30, 40 in a longitudinal direction and the edge plates 65*a* 65*b*, 66*a*, 66*b* are provided on the periphery of the main panel 15, and the upper or lower edge plates 65*a*, 65*b* of the main panel 15 have recesses 70 corresponding to the first strips 55 so that the second strips 60 of the sub panel 30, 40 may be inserted on the recesses 70 when the sub panels 30, 40 are joined on the upper or lower end of the main panel 15.

According to the other aspect of the invention, there is provided a decoration panel, wherein a plurality of horizontal score lines 75 are formed on the upper part or lower part of the main panel 15 so that the length of the main panel 15 may be adjustable by cutting the upper part or lower part of the main panel 15 along the score lines 75.

BRIEF DESCRIPTION OF THE DRAWINGS

FIGS. 2A and 2B are expanded views of particular features identified in FIG. 2.

FIG. 3 shows an assembled rear view of the invention.

FIG. 3A is an expanded view of a particular feature identified in FIG. 3.

DETAILED DESCRIPTION OF THE PREFERRED EMBODIMENT

Preferred embodiments of the invention will be described in detail below by referring to the accompanying drawings.

Figure 1:
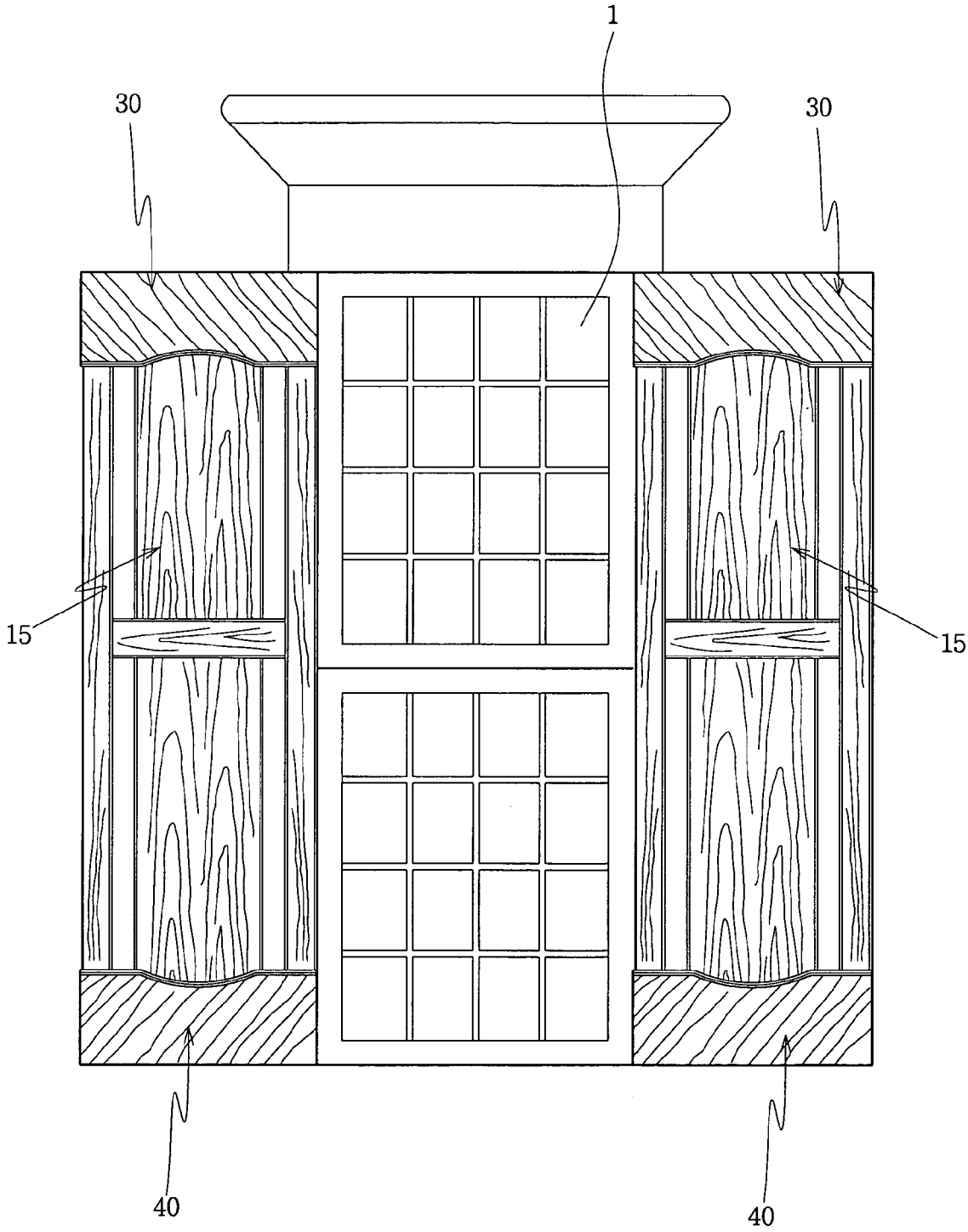
FIG. 1 shows the invention in use.
Figure 2:
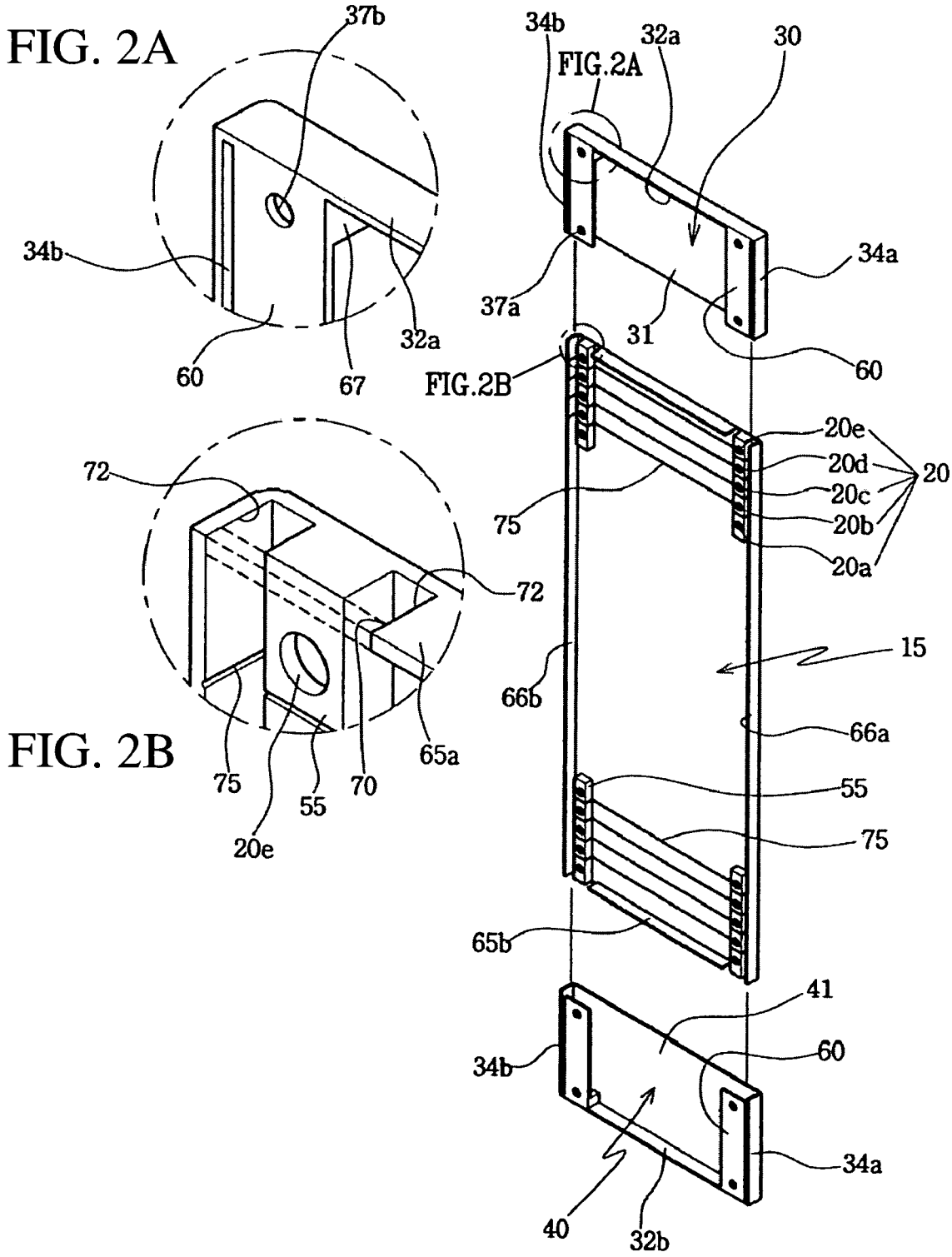
FIG. 2 shows an exploded rear view of the invention.

FIGS. 1 to 3 show the embodiment of the invention in which the decoration panel comprises main panel 15, sub panels 30, 40 inserted on the upper or lower end of the main panel 15, and joiners 50 fixing the sub panel onto the main panel 30, 40.

The main panel 15 is in a rectangular shape and has edge plates 65*a*, 65*b*, 66*a*, 66*b* disposed on the periphery of the rear side of it. The main panel 15 may be fixed on walls or a wall adjacent to the window 1 or to furniture by means of screws for example. The first strips 55 are provided in a longitudinal direction on the upper or lower part of rear side of the main panel 15, and a plurality of first holes 20 are formed along the first strips 55. The first holes 20 of the first strips 55 are preferably disposed at constant intervals, for example, at an interval of 1 inch. On the upper and lower edge plate 65*a*, 65*b* of the main panel 15 are provided recesses 70 to receive the second strips 60 of the sub panel 30, 40 mentioned below. And the second recesses 72 are formed on the both side of the recesses 70.

Figure 4:
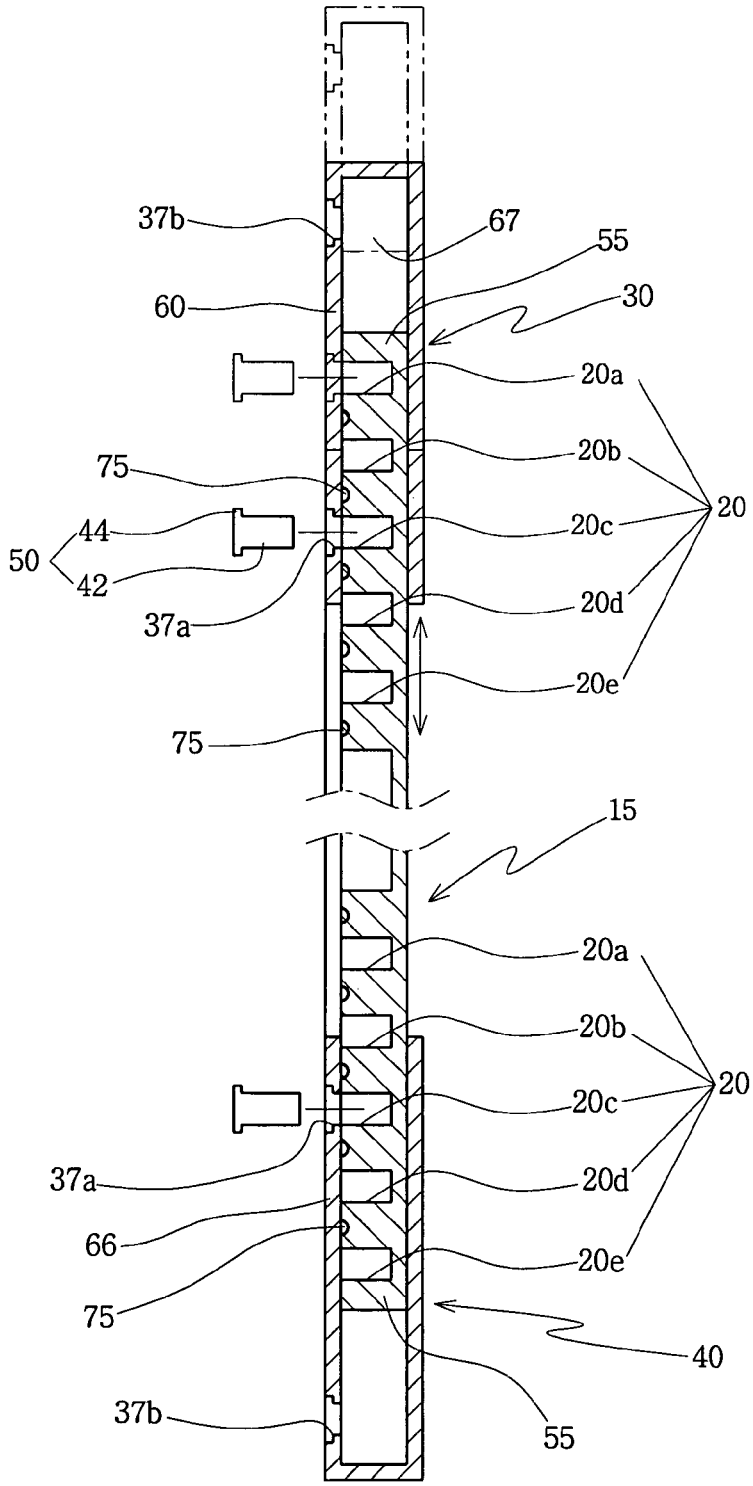
FIG. 4 shows a section along the line of A-A in FIG. 3.

The sub panel 30, 40 comprises an upper sub panel 30 and a lower sub panel 40 each being inserted on the upper end and lower end of the main panel 15. The upper sub panel 30 comprises a front cover 31, and top edge plate 32*a* and two side edge plates 34*a*, 34*b* disposed on the periphery of rear of the front cover 31. The second strips 60 are provided on the rear of the front cover 31 in a longitudinal direction corresponding to the first strips 55 of the main panel 15. And, second holes 37*a*, 37*b* are formed on the second strips 60. As the second strips 60 are disposed separately from the front cover 31 as shown in FIG. 4, the first strips 55 of the main panel 15 will be interposed between the main panel 15 and the second strips 60 of sub panel 30 in joined state. And a rib 67 is provided between the top edge plate 32*a* and the second strips 60 in order to attach the second strips 60 on the front cover 31 firmly.

The lower sub panel 40 also comprises a front cover 41 and bottom edge plate 32*b* and two side edge plates 34*a*, 34*b* on the periphery of the rear of the front cover 41. And the second strips 60 are provided on the rear of the front cover 41 in a longitudinal direction corresponding to the first strips 55 of the main panel 15. Also, second holes 37*a*, 37*b* are formed on the second strips 60. And, as the second strips 60 are disposed separately from the front cover 41, the first strips 55 of the main panel 15 will be interposed between the main panel 15 and the second strips 60 of sub panel 40 in joined state. And a rib 67 is provided between the bottom edge plate 32*b* and the second strips 60 to attach the second strips 60 on the front cover 41 firmly.

Preferably, the joiner 50 comprises a head 44 and a shaft 43 to be inserted into the first holes 20 of the first strips 55 and the second holes 37*a*, 37*b* of the second strips to join the sub panel 30, 40 with the main panel 15.

According to the invention as described above, the length of the decoration panel will be easily adjusted according to the dimension of the walls, windows or furniture on which the decoration panel should be installed by selecting the hole among the first holes 20*a*, 20*b*, 20*c*, 20*d*, 20*e* of the main panel 15 to be engaged with the second hole 37*a*, 37*b* of the sub panel 30, 40 and by fixing with joiner.

For example, if the vertical length of window is 70 inches and the length of the main panel is also 70 inches, the holes 37*a*, 37*b* of the sub panel 30, 40 should be aligned with the first hole 20*a* of the main panel 15 and the joiner 50 should be engaged on these holes 37*a*, 37*b* and 20*a*. And if the vertical length of window is 73 inches and the length of the main panel is 70 inches, the holes 37*a*, 37 of the sub panel 30, 40 should be aligned with the fourth hole 20*d* of the main panel 15 and the joiner 50 should be engaged on these holes 37*a*, 37*b* and 20*d*.

And, on the top side plate 65*a* and bottom side plate 65*b* are provided recesses 70 to receive the second strip 60 of the sub panel 30, 40. And, on both side of the recesses 70 are provided the second recesses 72 to receive a rib 67 of the first strips 55. Therefore, the sub panel 30, 40 could be joined smoothly with the upper and lower part of the main panel 15 without any protrusion on the rear surface.

Meanwhile, the main panel 15 is provided with a plurality of horizontal score lines 75 on the upper and lower part of it as shown in FIGS. 2 and 3. For example, the score lines 75 may have the interval of 1 inch. Therefore, the length of decoration panel could be shorten from the regular size of main panel by cutting along one of the score lines 75 as well as it could be lengthen from the regular size by extending the sub panel 30, 40 along the main panel 15.

According to the invention as described above, the length of the decoration panel is adjustable so that it could be used for various sizes of walls, windows, furniture and so on, and the cost of manufacturing apparatus or mould for the various panel sizes can be remarkably reduced.

What is claimed is:

1. A decoration panel adapted to be installed on walls, comprising a main panel having a plurality of first holes aligned along an upper or lower part of the main panel in a vertical direction, at least one sub panel having a front cover and a plurality of second holes on a rear of the front cover corresponding in spacing to the first holes, and being provided on an upper or lower end of the main panel, and at least one joiner being engaged through the second holes of the at least one sub panel into the first holes of the main panel to join the at least one sub panel to the upper or lower part of the main panel, said decoration panel having a length that is adjustable by selectively inserting the at least one joiner through one of the second holes of the at least one sub panel and into a corresponding first hole of the main panel;

wherein the first holes are formed on first strips disposed on the upper or lower part of the rear of the main panel in a longitudinal direction, and the second holes are formed on second strips disposed on the rear of the front cover of the at least one sub panel in the longitudinal direction, and including upper and lower edge plates on the ends of the main panel, and wherein the upper and lower edge plates of the main panel have recesses respectively defined across the first strips so that the second strips of the at least one sub panel are inserted in the respective recess when the at least one sub panel is joined to the upper or lower end of the main panel.

2. The decoration panel according to claim 1, wherein a plurality of horizontal score lines are formed on the upper part or lower part of the main panel so that the length of the main panel may be adjusted by cutting the upper part or lower part of the main panel along respective score lines.

* * * * *